US009159289B2

(12) United States Patent
Han et al.

(10) Patent No.: US 9,159,289 B2
(45) Date of Patent: Oct. 13, 2015

(54) LIQUID CRYSTAL DISPLAY AND THE DRIVING METHOD THEREOF

(71) Applicant: Shenzhen China Star Optoelectronics Technology Co., Ltd., Shenzhen, Guangdong (CN)

(72) Inventors: Bing Han, Shenzhen (CN); Jiang Zhu, Shenzhen (CN); Shih-Hsun Lo, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 322 days.

(21) Appl. No.: 13/878,563

(22) PCT Filed: Mar. 29, 2013

(86) PCT No.: PCT/CN2013/073421
§ 371 (c)(1),
(2) Date: Apr. 10, 2013

(87) PCT Pub. No.: WO2014/153768
PCT Pub. Date: Oct. 2, 2014

(65) Prior Publication Data

US 2014/0292733 A1 Oct. 2, 2014

(51) Int. Cl.
*G09G 3/36* (2006.01)

(52) U.S. Cl.
CPC ..... *G09G 3/3677* (2013.01); *G09G 3/3674* (2013.01); *G09G 2320/0223* (2013.01)

(58) Field of Classification Search
CPC . G09G 3/3677; G09G 3/3611; G09G 3/3666; G09G 2310/08; G09G 2310/0269; G09G 2320/0223
USPC ..... 345/94, 87, 211, 204, 99, 208, 100
See application file for complete search history.

(56) References Cited

U.S. PATENT DOCUMENTS

| | | | | |
|---|---|---|---|---|
| 2004/0189629 | A1* | 9/2004 | Fukutoku | 345/211 |
| 2009/0079715 | A1* | 3/2009 | Kim | 345/204 |
| 2010/0194735 | A1* | 8/2010 | Ohtsubo | 345/211 |

* cited by examiner

*Primary Examiner* — Kathy Wang-Hurst
*Assistant Examiner* — Jose Soto Lopez
(74) *Attorney, Agent, or Firm* — Andrew C. Cheng

(57) ABSTRACT

A liquid crystal display and the driving method thereof are disclosed. The liquid crystal display includes a plurality of pixels, data lines for transmitting data driving signals to the pixels, a scanning driver for generating scanning driving signals, a waveform shaping circuit for connecting with the scanning driver, a plurality of scanning lines for transmitting the shaped scanning driving signal to the pixels. The waveform shaping circuit shapes the waveforms of the scanning driving signal along a rising edge. In this way, the voltage difference between the pixel electrodes is eliminated. Thus, the color shift is reduced, and the display performance of the liquid crystal display is enhanced.

18 Claims, 3 Drawing Sheets

LIQUID CRYSTAL DISPLAY AND THE DRIVING METHOD THEREOF

BACKGROUND OF THE INVENTION

1. Field of the Invention

Embodiments of the present disclosure relate to display technology, and more particularly to a liquid crystal display and the driving method thereof.

2. Discussion of the Related Art

FIG. 1 is a waveform diagram showing scanning driving signals and data driving signals of typical pixels of the same column. As shown in FIG 1, for thin film transistor liquid crystal display (TFT-LCD), scanning lines are for transmitting "Gate" scanning driving signals to TFTs to turn on the TFTs. Data lines are for transmitting the "Data" driving signals to the pixels ("Pix") to supply the power to the pixels when the TFTs are turn on such that the display of the pixels are controlled. The pixels respectively displays red (R), green (G), and blue (B).

For typical liquid crystal displays, the "Gate" scanning driving signals may be delayed during the transition from the low potential to the high potential due to resistors and capacitors. As shown in FIG. 1, the waveform of one "Gate" scanning driving signal is better than that of the previous one such that the waveform of the "Data" driving signal of the R pixels is better than that of the G pixels. It can be understood that the voltage input to the R pixel is higher. Thus, the display effects of the R pixels and G pixels are not uniformly mixed, which seriously affects display performance of the TFT-LCD.

SUMMARY

The object of the claimed invention is to provide a liquid crystal display and the driving method to eliminate the voltage difference between the pixel electrodes. In this way, the color shift is reduced, and the display performance of the liquid crystal display is enhanced.

In one aspect, a liquid crystal display includes: a plurality of pixels comprising thin film transistors (TFTs) and pixel electrodes, each TFT includes a gate, a source and a drain, and the pixel electrode connects to the drain; a scanning driver for generating scanning driving signals; a waveform shaping circuit for connecting with the scanning driver, the waveform shaping circuit shapes waveforms of the scanning driving signal along a rising edge; a plurality of scanning lines connecting to the gate for transmitting the shaped scanning driving signal to the gate to turn on the TFTs; a plurality of data lines connecting to the source so as to transmit the data driving signals to the pixel electrodes via the source when the TFTs are turn on; and wherein the rising edge of the shaped scanning driving signal includes at least a first tilted portion.

Wherein the first tilted portion tilts upward from a first level to a high potential of the scanning driving signal, and the first level is between the high potential and a low potential of the scanning driving signal.

Wherein the waveform shaping circuit further shapes the waveform of the falling edge of the scanning driving signal.

Wherein the falling edge of the shaped scanning driving signal includes at least a second tilted portion.

Wherein the second tilted portion tilts downward from a second level to the low potential of the scanning driving signal, and the second level is between the high potential and the low potential of the scanning driving signal.

Wherein the waveform shaping circuit includes a first N-type MOS transistor, a second N-type MOS transistor, a P-type MOS transistor, a first resistor, a second resistor, a third resistor, a RC circuit, and a first capacitor, wherein the gate of the first N-type MOS transistor receives the scanning driving signals, the source of the first N-type MOS transistor is grounded, the drain of the first N-type MOS transistor connects to the source of the P-type MOS transistor via the first resistor and the second resistor to receive the reference voltage signal, the gate of the P-type MOS transistor connects between the first resistor and the second resistor, the source of the P-type MOS transistor connects to the scanning line, the source of the second N-type MOS transistor is grounded, the gate of the second N-type MOS transistor connects to the negative signal of the scanning driving signals, the drain of the second N-type MOS transistor connects to the drain of the P-type MOS transistor via the third resistor, the first ends of the RC circuit and the first capacitor connect between the connecting point of the drain of the P-type MOS transistor and the third resistor and the scanning line, and the second ends of the RC circuit and the first capacitor are grounded.

Wherein the RC circuit includes a second capacitor and a fourth resistor that are serially connected, a voltage range of the first tilted portion is controlled by the resistance of the fourth resistor, and a time range of the first tilted portion is controlled by the capacitance of the second capacitor.

In another aspect, a liquid crystal display includes: a plurality of pixels; a plurality of data lines for transmitting data driving signals to the pixels: a scanning driver for generating scanning driving signals; a waveform shaping circuit for connecting with the scanning driver, the waveform shaping circuit shapes waveforms of the scanning driving signal along a rising edge; a plurality of scanning lines for transmitting the shaped scanning driving signal to the pixels.

Wherein the pixels comprise TFTs and pixel electrodes, each TFT includes a gate, a source and a drain, and the pixel electrode connects to the drain, scanning lines connecting to the gate for transmitting the shaped scanning driving signal to the gate to turn on the TFTs, the data lines connecting to the source so as to transmit the data driving signals to the pixel electrodes via the source when the TFTs are turn on.

Wherein the rising edge of the shaped scanning driving signal includes at least a first tilted portion.

Wherein the first tilted portion tilts upward from a first level to a high potential of the scanning driving signal, and the first level is between the high potential and a low potential of the scanning driving signal.

Wherein the waveform shaping circuit further shapes the waveform of the falling edge of the scanning driving signal.

Wherein the falling edge of the shaped scanning driving signal includes at least a second tilted portion.

Wherein the second tilted portion tilts downward from a second level to the low potential of the scanning driving signal, and the second level is between the high potential and the low potential of the scanning driving signal.

Wherein the waveform shaping circuit includes a first N-type MOS transistor, a second N-type MOS transistor, a P-type MOS transistor, a first resistor, a second resistor, a third resistor, a RC circuit, and a first capacitor, wherein the gate of the first N-type MOS transistor receives the scanning driving signals, the source of the first N-type MOS transistor is grounded, the drain of the first N-type MOS transistor connects to the source of the P-type MOS transistor via the first resistor and the second resistor to receive the reference voltage signal, the sate of the P-type MOS transistor connects between the first resistor and the second resistor, the source of the P-type MOS transistor connects to the scanning line, the source of the second N-type MOS transistor is grounded, the gate of the second N-type MOS transistor connects to the negative signal of the scanning driving signals, the drain of the second N-type MOS transistor connects to the drain of the P-type MOS transistor via the third resistor, the first ends of the RC circuit and the first capacitor connect between the connecting point of the drain of the P-type MOS transistor and the third resistor and the scanning line, and the second ends of the RC circuit and the first capacitor are grounded.

Wherein the RC circuit includes a second capacitor and a fourth resistor that are serially connected, a voltage range of the first tilted portion is controlled by the resistance of the fourth resistor, and a time range of the First tilted portion is controlled by the capacitance of the second capacitor.

In another aspect, a driving method of q liquid crystal display includes: providing scanning driving signal; shaping a rising edge of the scanning driving signal; and transmitting the shaped scanning driving signal to scanning lines.

In view of the above, the waveform shaping circuit shapes the waveforms of the scanning driving signal along the rising edge. The shaped scanning driving signal is transmitted to the pixels via the scanning lines such that the voltage supplied to the pixel electrode of each pixels is similar or the same. In this way, the brightness of the pixels are similar or the same. The color shift is reduced and the display performance is enhanced.

DETAILED DESCRIPTION OF THE EMBODIMENTS

Embodiments of the invention will now be described more fully hereinafter with reference to the accompanying drawings, in which embodiments of the invention are shown.

Figure 1:
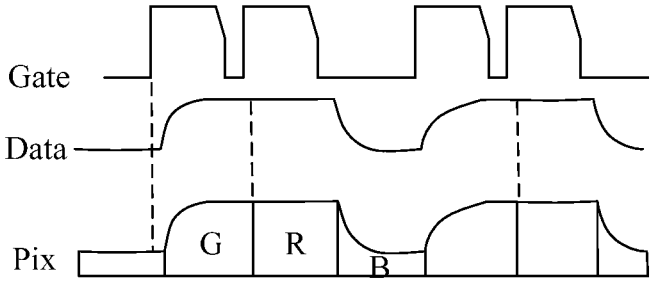
FIG. 1 is a waveform diagram showing scanning driving signals and data driving signals of typical pixels of the same column.
Figure 2:
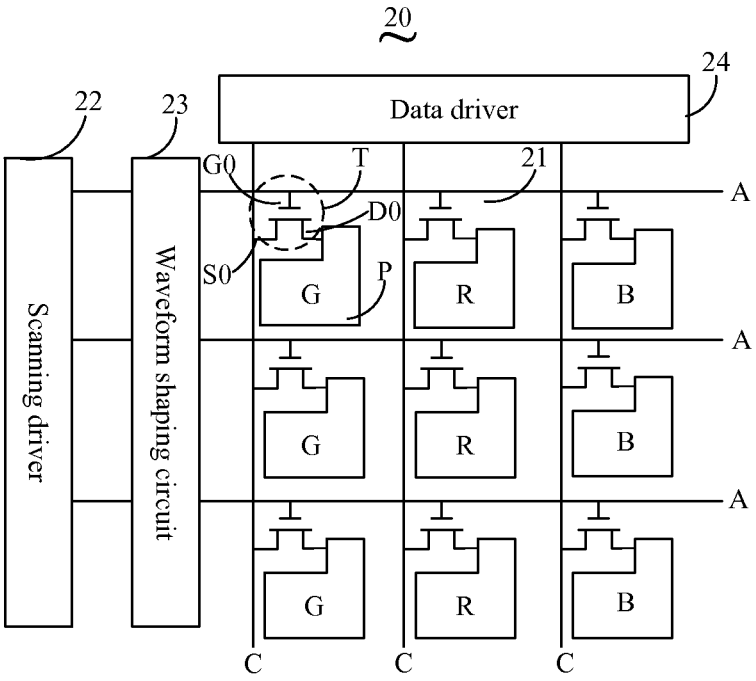
FIG. 2 is a schematic view of the liquid crystal display in accordance with a first embodiment.

FIG. 2 is a schematic view of the liquid crystal display in accordance with a first embodiment. The liquid crystal display 20 includes a plurality of pixels 21, a scanning driver 22 for generating scanning driving signals, a waveform shaping circuit 23 connecting with the scanning driver 22, a data driver 24 for generating data driving signals, a plurality of scanning lines (A) and a plurality of data lines (C). The data lines connect to the data driver 24 for transmitting the data driving signals to the pixels 21. The waveform shaping circuit 23 shapes the waveform of the scanning driving signals along the rising edge. The scanning lines connect to the waveform shaping circuit 23 for transmitting the shaped scanning driving signals to the pixels 21.

In order to reduce the impact toward the horizontal line between two adjacent pixels 21, the waveform shaping circuit 23 further shapes the waveform of the scanning driving signals along the falling edge.

Specifically, the pixels 21 include the TFTs (T) and the pixel electrodes (P). Each of the TFTs includes a gate (G0), a source (S0), and a drain (D0). The pixel electrode (P) connects to the drain (D0), the scanning lines (A) connect to the gate (G0) to transmit the shaped scanning driving signals to the gate (G0). In this way, the TFTs (T) are turn on. The data lines (C) connect to the source (S0) so as to transmit the data driving signals to the pixel electrode (P) via the source (S0) when the TFTs are turn on.

In one embodiment, one scanning line (A) drives a plurality of pixels 21. As shown in FIG. 2, the pixels 21 respectively displays red (R), green (G), and blue (B). The pixels 21 driven by the same scanning line (A) are turn on when the scanning line transmits the scanning driving signals. A plurality of data lines (C) transmit data driving signals to the pixel electrodes (P) of corresponding pixels 21 at the same time so as to supply power to the pixels 21 displaying different colors. In the embodiment, the scanning driving signals generated by the scanning driver 22 are delayed during the transition from the low potential to the high potential due to resistors and capacitors. Thus, the waveform shaping circuit 23 shown in FIG. 3 shapes the waveform of the scanning driving signals.

Figure 3:
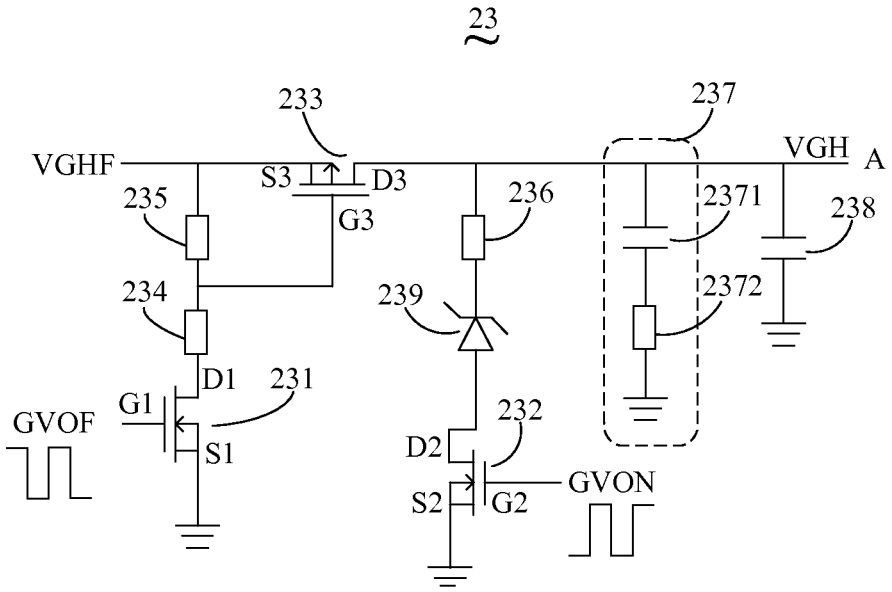
FIG. 3 is a circuit diagram of a waveform shaping circuit in accordance with one embodiment.

Referring to FIG. 3, the waveform shaping circuit 23 includes a first N-type MOS transistor 231, a second N-type MOS transistor 232, a P-type MOS transistor 233, a first resistor 234, a second resistor 235, a third resistor 236, a RC circuit 237, and a first capacitor 238. The gate (G1) of the first N-type MOS transistor 231 receives the scanning driving signals (GVOF). The source (S1) of the first N-type MOS transistor 231 is grounded. The drain (D1) of the first N-type MOS transistor 231 connects to the source (S3) of the P-type MOS transistor 233 via the first resistor 234 and the second resistor 235 and receives the reference voltage signal (VGHF). The gate (G3) of the P-type MOS transistor 233 connects between the first resistor 234 and the second resistor 235. The source (D3) of the P-type MOS transistor 233 connects to the scanning line (A). The source (S2) of the second N-type MOS transistor 232 is grounded. The gate (G2) of the second N-type MOS transistor 232 connects to the negative signal (GVON) of the scanning driving signals. The drain (D2) of the second N-type MOS transistor 232 connects to the drain (D3) of the P-type MOS transistor 233 via the third resistor 236. The first ends of the RC circuit 237 and the first capacitor 238 connect between the connecting point of the drain (D3) of the P-type MOS transistor 233 and the third resistor 236 and the scanning line (A). The second ends of the RC circuit 237 and the first capacitor 238 are grounded.

In addition, a reference diode 239 is arranged between the second N-type MOS transistor 232 and the third resistor 236. The positive end of the reference diode 239 connects to the drain (D2) of the second N-type MOS transistor 232, and the negative end of the reference diode 239 connects to the third resistor 236. The RC circuit 237 includes a second capacitor 2371 and a fourth resistor 2372 that are serially connected. The first end of the second capacitor 2371 connects between the connecting point of the drain (D3) of the P-type MOS transistor 233 and the third resistor 236 and the scanning line (A). The second end of the second capacitor 2371 connects to the first end of the fourth resistor 2372. The second end of the fourth resistor 2372 is grounded.

The operations of the waveform shaping circuit 23 of FIG. 3 will be described hereinafter.

In one embodiment, the first N-type MOS transistor 231 is turn off when the scanning driving signal (GVOF) is at a low potential. The voltage of the gate (G3) of the P-type MOS transistor 233 equals to that of the source (S3) when the P-type MOS transistor 233 is turn off. At this moment, the negative signal (GVON) of the scanning driving signal is at a high potential. The second N-type MOS transistor 232 is turn on and such that the positive end of the reference diode 239 is grounded. In this way, the scanning driving signal (VGH) of the scanning line (A) is shaped along the falling edge. When the scanning driving signal (GVOF) is at a high potential, the first N-type MOS transistor 231 is turn on. The gate (G3) of the P-type MOS transistor 233 is at the low potential. The voltage of the gate (G3) of the P-type MOS transistor 233 is less than that of the source (S3). The P-type MOS transistor 233 is turn on and the reference voltage signal (VGHF) is transmitted to the scanning line (A). At this moment, the scanning driving signal (VGH) is shaped along the rising edge via the RC circuit 237. In addition, the negative signal (GVON) of the scanning driving signal is at the low potential, and the second N-type MOS transistor 232 is turn off. The reference diode 239 is also turn off such that the scanning driving signal (VGH) of the scanning line (A) is not shaped.

Figure 4:
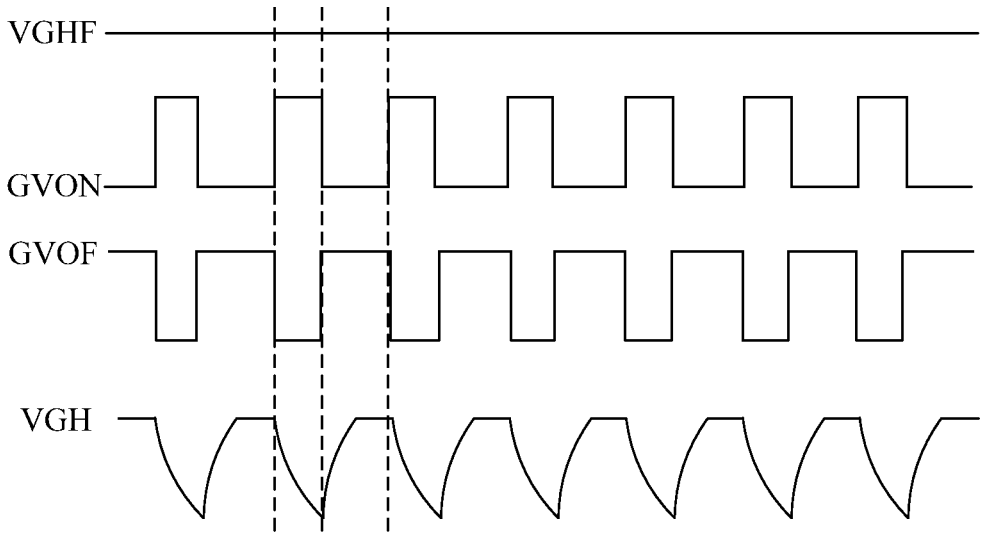
FIG. 4 is a waveform diagram of the signals input to and output from the waveform shaping circuit.

FIG. 4 is a waveform diagram of the signals input to and output from the waveform shaping circuit. Also referring to FIG. 4, the original scanning driving signal (GVOF) generated by the scanning driver 22 is shaped by the waveform shaping circuit 23 to obtain the shaped scanning driving signal (VGH). In the embodiment, the rising edge and the falling edge of the shaped scanning driving signal (VGH) include at least a tilted portion. As shown in FIG. 4, the rising edge and the falling edge includes are tilted portions. In other embodiment, the rising edge and the filling edge of the shaped scanning driving signal (VGH) may be one tiled portion with a straight line as shown in FIG. 5.

Figure 5:
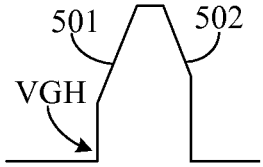
FIG. 5 is a waveform diagram showing the scanning driving signals after being shaped.

Referring to FIG. 5, the rising edge of the shaped scanning driving signal (VGH) includes a first tilted portion 501. The first tilted portion 501 tilts upward from the first level to the high potential of the scanning driving signal (VGH). The first level is between the high potential and the low potential of the scanning driving signal (VGH). In the embodiment, the voltage range of the first tilted portion 501 is controlled by the resistance of the fourth resistor 2372. and the time range of the first tilted portion 501 is controlled by the capacitance of the second capacitor 2371. Specifically, the resistance of the fourth resistor 2372 is inversely dependent upon the voltage range of the first tilted portion 501. The capacitance of the second capacitor 2371 is inversely dependent upon the time range, i.e., the time needed to perform the waveform shaping.

Similarly, the falling edge of the shaped scanning driving signal (VGH) includes a second tilted portion 502. The second tilted portion 502 tilts downward from the second level to the low potential of the scanning driving signal (VGH). The second level is between the high potential and the low potential of the scanning driving signal (VGH). In the embodiment, the lowest voltage within the voltage range of the second tilted portion 502 is controlled by the reference diode 239.

It is to be noted that the waveform shaping circuit 23 only shapes the rising edge and the filling edge of the scanning driving signal (GVOF). Thus, the high potential and the low potential of the scanning driving signal (VGH) respectively equals to the high potential and the low potential of the scanning driving signal (GVOF).

Therefore, the waveforms of the rising edge of the scanning driving signal (VGH) are similar or the same such that the time to turn on each of the TFTs (T) is close or the same. In this way, the voltage supplied to the pixel electrode (P) of each pixels 21 is similar or the same so as to ensure the brightness of the pixels 21 are similar or the same. Thus, the color shift is reduced and the display performance is enhanced.

Figure 6:
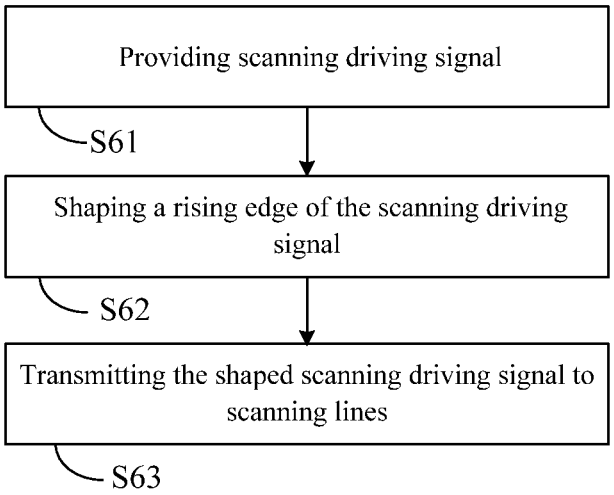
FIG. 6 is a flowchart showing the driving method of the liquid crystal display in accordance with the second embodiment.

FIG. 6 is a flowchart showing the driving method of the liquid crystal display in accordance with the second embodiment. The driving method includes the following steps. In step S61, the scanning driving signal is provided.

in step S62 the rising edge of the scanning driving signal is shaped. In order to reduce the impact toward the horizontal line between two adjacent pixels, the waveform of the falling edge of the scanning driving signal is further shaped.

In step S63, the shaped scanning driving signal is transmitted to the gate of the TFTs by the scanning line so as to turn on the TFTs. When the TFTs are turn on, the scanning driving signal is transmitted to the source of the TFTs by the data lines, and then is further transmitted to the pixel electrodes via the source of the TFTs. The pixel electrodes display according to the received data driving signals. As the waveform of the rising edge of the scanning driving signal is shaped, the time to turn on each of the TFTs (T) is close or the same. In this way, the voltage supplied to the pixel electrode (P) of each pixels 21 is similar or the same so as to ensure the brightness of the pixels are similar or the same. Thus, the color shift is reduced and the display performance is enhanced.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal display, comprising:

a plurality of pixels comprising thin film transistors (TFTs) and pixel electrodes, each TFT comprises a gate, a source and a drain, and the pixel electrode connects to the drain;

a scanning driver for generating scanning driving signals;

a waveform shaping circuit for connecting with the scanning driver, the waveform shaping circuit shapes waveforms of the scanning driving signal along a rising edge;

a plurality of scanning lines connecting to the gate for transmitting the shaped scanning driving signal to the gate to turn on the TFTs;

a plurality of data lines connecting to the source so as to transmit data driving signals to the pixel electrodes via the source when the TFTs are turn on;

wherein the rising edge of the shaped scanning driving signal comprises at least a first tilted portion; and wherein the waveform shaping circuit comprises a first N-type MOS transistor, a second N-type MOS transistor, a P-type MOS transistor, a first resistor, a second resistor, a third resistor, a RC circuit, and a first capacitor, first ends of the RC circuit and the first capacitor connect between a connecting point of the drain of the P-type MOS transistor and the third resistor and the scanning line, and second ends of the RC circuit and the first capacitor are grounded, the RC circuit comprises a second capacitor and a fourth resistor that are serially connected, a voltage range of the first tilted portion is controlled b the resistance of the fourth resistor, and a time range of the first tilted portion is controlled by the capacitance of the second capacitor.

2. The liquid crystal display as claimed in claim 1, wherein the first tilted portion tilts upward from a first level to a high potential of the scanning driving signal, and the first level is between the high potential and a low potential of the scanning driving signal.

3. The liquid crystal display as claimed in claim 2, wherein the waveform shaping circuit further shapes the waveform of a falling edge of the scanning driving signal.

4. The liquid crystal display as claimed in claim 3, wherein the falling edge of the shaped scanning driving signal comprises at least a second tilted portion.

5. The liquid crystal display as claimed in claim 4, wherein the second tilted portion tilts downward from a second level to the low potential of the scanning driving signal, and the second level is between the high potential and the low potential of the scanning driving signal.

6. The liquid crystal display as claimed in claim 1, wherein the gate of the first N-type MOS transistor receives the scanning driving signals, the source of the first N-type MOS transistor is grounded, the drain of the first N-type MOS transistor connects to the source of the P-type MOS transistor via the first resistor and the second resistor to receive a reference voltage signal, the gate of the P-type MOS transistor connects between the first resistor and the second resistor, the source of the P-type MOS transistor connects to the scanning line, the source of the second N-type MOS transistor is grounded, the gate of the second N-type MOS transistor connects to a negative signal of the scanning driving signals, the drain of the second N-type MOS transistor connects to the drain of the P-type MOS transistor via the third resistor.

7. A liquid crystal display, comprising:

a plurality of pixels;

a plurality of data lines for transmitting data driving signals to the pixels;

a scanning driver for generating scanning driving signals;

a waveform shaping circuit for connecting with the scanning driver, the waveform shaping circuit shapes waveforms of the scanning driving signal along a rising edge;

a plurality of scanning lines for transmitting the shaped scanning driving signal to the pixels; and wherein the waveform shaping circuit comprises a first N-type MOS transistor, a second N-type MOS transistor, a P-type MOS transistor, a first resistor, a second resistor, a third resistor, a RC circuit, and a first capacitor, first ends of the RC circuit and the first capacitor connect between a connecting point of the drain of the P-type MOS transistor and the third resistor and the scanning line, and second ends of the RC circuit and the first capacitor are grounded, the RC circuit comprises a second capacitor and a fourth resistor that are serially connected, a voltage range of the first tilted portion is controlled by the resistance of the fourth resistor, and a time range of the first tilted portion is controlled by the capacitance of the second capacitor.

8. The liquid crystal display as claimed in claim 7, wherein the pixels comprise TFTs and pixel electrodes, each TFT comprises a gate, a source and a drain, and the pixel electrode connects to the drain, scanning lines connecting to the gate for transmitting the shaped scanning driving signal to the gate to turn on the TFTs, the data lines connecting to the source so as to transmit the data driving signals to the pixel electrodes via the source when the TFTs are turned on.

9. The liquid crystal display as claimed in claim 7, wherein the rising edge of the shaped scanning driving signal comprises at least a first tilted portion.

10. The liquid crystal display as claimed in claim 9, wherein the first tilted portion tilts upward from a first level to a high potential of the scanning driving signal, and the first level is between the high potential and a low potential of the scanning driving signal.

11. The liquid crystal display as claimed in claim 10, wherein the waveform shaping circuit further shapes the waveform of a falling edge of the scanning driving signal.

12. The liquid crystal display as claimed in claim 10, wherein the falling edge of the shaped scanning driving signal comprises at least a second tilted portion.

13. The liquid crystal display as claimed in claim 12, wherein the second tilted portion tilts downward from a second level to the low potential of the scanning driving signal, and the second level is between the high potential and the low potential of the scanning driving signal.

14. The liquid crystal display as claimed in claim 7, wherein the gate of the first N-type MOS transistor receives the scanning driving signals, the source of the first N-type MOS transistor is grounded, the drain of the first N-type MOS transistor connects to the source of the P-type MOS transistor via the first resistor and the second resistor to receive a reference voltage signal, the gate of the P-type MOS transistor connects between the first resistor and the second resistor, the source of the P-type MOS transistor connects to the scanning line, the source of the second N-type MOS transistor is grounded, the gate of the second N-type MOS transistor connects to the negative signal of the scanning driving signals, the drain of the second N-type MOS transistor connects to the drain of the P-type MOS transistor via the third resistor.

15. A driving method a liquid crystal display, comprising:

providing scanning driving signals;

shaping a rising edge of the scanning driving signal by a waveform shaping circuit, wherein the rising edge of the shaped scanning driving signal comprises at least a first tilted portion;

transmitting the shaped scanning driving signal to scanning lines; and wherein the waveform shaping circuit comprises a first N-type MOS transistor, a second N-type MOS transistor, a P-type MOS transistor, a first resistor, a second resistor, a third resistor, a RC circuit, and a first capacitor, first ends of the RC circuit and the first capacitor connect between a connecting point of the drain of the P-type MOS transistor and the third resistor and the scanning line, and second ends of the RC circuit and the first capacitor are grounded, the RC circuit comprises a second capacitor and a fourth resistor that are serially connected, a voltage range of the first tilted portion is controlled b the resistance of the fourth resistor, and a time range of the first tilted portion is controlled by the capacitance of the second capacitor.

16. The driving method as claimed in claim 15, wherein the first tilted portion tilts upward from a first level to a high potential of the scanning driving signal, and the first level is between the high potential and a low potential of the scanning driving signal.

17. The driving method as claimed in claim 16, wherein the waveform shaping circuit further shapes the waveform of a falling edge of the scanning driving signal.

18. The driving method as claimed in claim 17, wherein the falling edge of the shaped scanning driving signal comprises at least a second tilted portion, the second tilted portion tilts downward from a second level to the low potential of the scanning driving signal, and the second level is between the high potential and the low potential of the scanning driving signal.

* * * * *